US009541083B2

(12) United States Patent
Jang et al.

(10) Patent No.: US 9,541,083 B2
(45) Date of Patent: Jan. 10, 2017

(54) SCROLL COMPRESSOR INCLUDING COMMUNICATION HOLE WITH IMPROVED BACK PRESSURE CHAMBER AND BACK PRESSURE HOLE LOCATIONS

(71) Applicant: LG ELECTRONICS INC., Seoul (KR)

(72) Inventors: Kitae Jang, Seoul (KR); Inho Won, Seoul (KR); Junchul Oh, Seoul (KR); Yanghee Cho, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 507 days.

(21) Appl. No.: 13/672,846

(22) Filed: Nov. 9, 2012

(65) Prior Publication Data

US 2013/0121865 A1 May 16, 2013

(30) Foreign Application Priority Data

Nov. 9, 2011 (KR) ..... 10-2011-0116641

(51) Int. Cl.
*F04C 18/02* (2006.01)
*F04C 18/00* (2006.01)

(52) U.S. Cl.
CPC ..... *F04C 18/00* (2013.01); *F04C 18/02* (2013.01); *F04C 18/0253* (2013.01); *F04C 18/0261* (2013.01); *F04C 18/0292* (2013.01)

(58) Field of Classification Search
CPC ..... F04C 18/00; F04C 18/02; F04C 18/0253; F04C 18/0261; F04C 18/0292; F04C 18/0215; F04C 2240/80; F04C 23/008; F04C 27/005
USPC ..... 418/55.1, 55.2
See application file for complete search history.

(56) References Cited

U.S. PATENT DOCUMENTS

| | | | |
|---|---|---|---|
| 4,596,521 A | 6/1986 | Murayama et al. | 418/55 |
| 4,649,611 A | 3/1987 | Ikeda et al. | |
| 6,227,831 B1 | 5/2001 | Osima et al. | |
| 6,755,632 B1 | 6/2004 | Ito et al. | |

(Continued)

FOREIGN PATENT DOCUMENTS

| | | |
|---|---|---|
| CN | 1276484 | 12/2000 |
| CN | 1427160 | 7/2003 |

(Continued)

OTHER PUBLICATIONS

WO/2011/1027567, Nagahara et al., published on Mar. 10, 2011.*

(Continued)

*Primary Examiner* — Nicholas J Weiss
*Assistant Examiner* — Paul Thiede
(74) *Attorney, Agent, or Firm* — KED & Associates, LLP

(57) ABSTRACT

A scroll compressor is provided. The scroll compressor may include a communication hole formed in a fixed scroll for communicating a discharge space and a thrust bearing surface with each other. This may reduce frictional loss between the fixed scroll and an orbiting scroll. Further, if a high vacuum state is about to occur during operation of the compressor, refrigerant in the discharge space may be introduced into the compression chambers through the communication hole. This may prevent the occurrence of a high vacuum state to thereby prevent damage to the compressor. Additionally, when the compressor is stopped, a pressure equilibrium operation may be performed through the communication hole.

15 Claims, 7 Drawing Sheets

(56) References Cited

U.S. PATENT DOCUMENTS

| | | | | |
|---|---|---|---|---|
| 6,776,593 | B1 | 8/2004 | Cho | 418/55.3 |
| 7,195,470 | B2 * | 3/2007 | Kimura | F04C 18/0215 418/55.1 |
| 2012/0164014 | A1 | 6/2012 | Nagahara et al. | 418/55.1 |
| 2012/0177523 | A1 | 7/2012 | Won et al. | 418/55.5 |
| 2013/0121865 | A1 | 5/2013 | Jang et al. | 418/55.1 |
| 2013/0121866 | A1 | 5/2013 | Jang et al. | 418/55.5 |

FOREIGN PATENT DOCUMENTS

| | | | |
|---|---|---|---|
| CN | 101142409 | A | 3/2008 |
| CN | 100532847 | C | 8/2009 |
| CN | 100538077 | C | 9/2009 |
| CN | 101900115 | | 12/2010 |
| CN | 101988497 | | 3/2011 |
| DE | 196 42 798 | | 11/1997 |
| EP | 1 059 447 | | 12/2000 |
| JP | S53-119412 | | 10/1978 |
| JP | 59-079091 | | 5/1984 |
| JP | 60-252185 | A | 12/1985 |
| JP | 61-192882 | | 8/1986 |
| JP | 63-106386 | A | 5/1988 |
| JP | 63-106387 | A | 5/1988 |
| JP | 5-149270 | | 6/1993 |
| JP | 11-044295 | A | 2/1999 |
| JP | 2003-232285 | | 8/2003 |
| JP | 2010-007550 | A | 1/2010 |
| KR | 10-2001-0007061 | | 1/2001 |
| WO | WO 2007/114531 | | 10/2007 |
| WO | WO 2011/027567 | | 3/2011 |

OTHER PUBLICATIONS

English Machine Translation of DE 19 642 798 A1 (translated Jul. 12, 2014).*

United States Office Action dated Sep. 10, 2013 issued in U.S. Appl. No. 13/346,835.

European Search Report issued in EP Application No. 12191845.2 dated Feb. 11, 2013.

Final Office Action dated May 8, 2014, issued in U.S. Appl. No. 13/346,835.

U.S. Appl. No. 13/672,838, filed Nov. 9, 2012.

Chinese Office Action issued in Appln No. 201210018076.8 dated Jan. 3, 2014.

Chinese Office Action dated Aug. 22, 2014. (Translation) (201210018076.8).

U.S. Appl. No. 13/346,835, filed Jan. 10, 2012.

U.S. Appl. No. 13/672,829, filed Nov. 9, 2012.

Chinese Office Action dated Dec. 1, 2014.

Chinese Office Action dated Dec. 9, 2014.

Office Action issued in U.S. Appl. No. 13/346,835 dated Mar. 25, 2015.

Office Action issued in U.S. Appl. No. 13/672,829 dated Mar. 26, 2015.

Chinese Office Action issued in Application No. 201210447408.4 dated Aug. 14, 2015.

U.S. Office Action issued in co-pending U.S. Appl. No. 13/346,835 dated Oct. 8, 2015.

* cited by examiner

SCROLL COMPRESSOR INCLUDING COMMUNICATION HOLE WITH IMPROVED BACK PRESSURE CHAMBER AND BACK PRESSURE HOLE LOCATIONS

CROSS-REFERENCE TO RELATED APPLICATION(S)

This application claims priority under 35 U.S.C. §119 to Korean Application No. 10-2011-0116641 filed on Nov. 9, 2011, whose entire disclosure is hereby incorporated by reference.

BACKGROUND

1. Field

This relates to a scroll compressor, and particularly, to a scroll compressor having a separation-type orbiting scroll.

2. Background

A scroll compressor may compress a refrigerant gas by changing a volume of compression chambers formed by a pair of scrolls facing each other. When compared with a reciprocating compressor or a rotary compressor, the scroll compressor may have higher efficiency, lower vibration and noise, smaller size and lighter weight.

BRIEF DESCRIPTION OF THE DRAWINGS

The embodiments will be described in detail with reference to the following drawings in which like reference numerals refer to like elements wherein.

DETAILED DESCRIPTION

Figure 1:
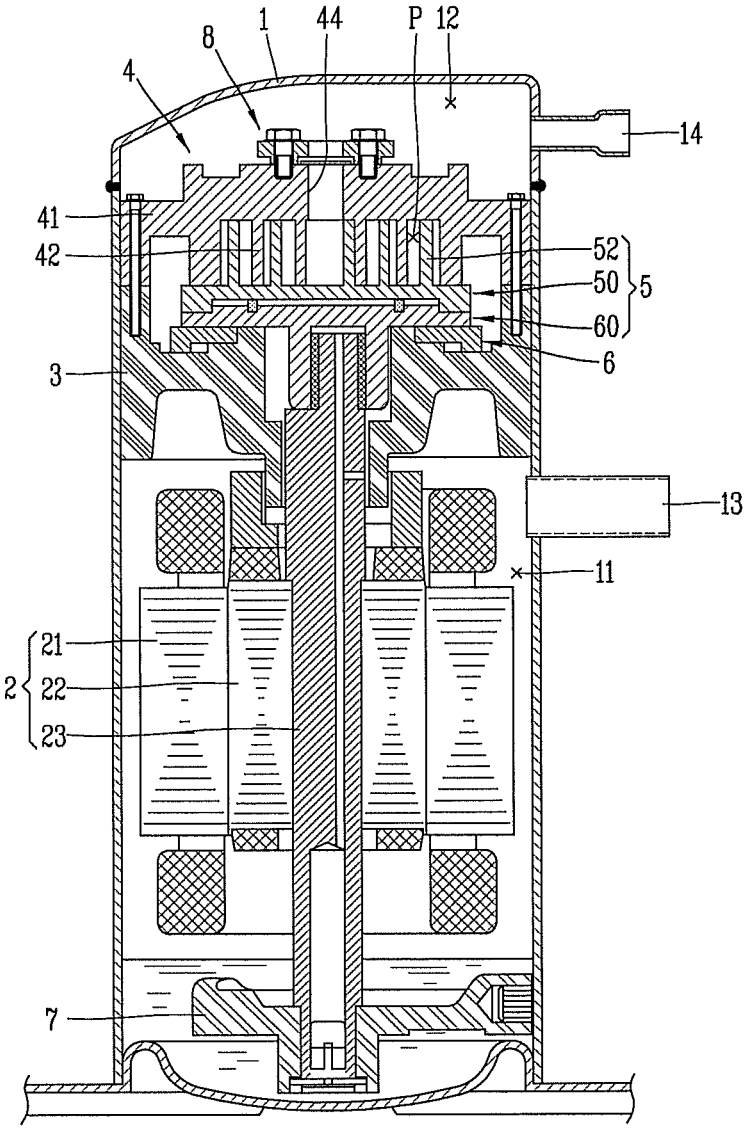
FIG. 1 is a sectional view of a scroll compressor according to an embodiment as broadly described herein.

Description will now be given in detail of exemplary embodiments, with reference to the accompanying drawings. For the sake of brief description with reference to the drawings, the same or equivalent components will be provided with the same reference numbers, and description thereof will not be repeated.

Scroll compressors may be categorized into low-pressure scroll compressors or high-pressure scroll compressors according to a type of refrigerant supplied into the compression chambers. In a low-pressure scroll compressor, refrigerant is indirectly sucked into compression chambers via an inner space of a casing which is divided into a suction space and a discharge space. In a high-pressure scroll compressor, refrigerant is directly sucked into compression chambers without passing through an inner space of the casing, and is then discharged to a discharge space in the inner space of the casing.

Scroll compressors may be also categorized into tip seal type or back pressure type scroll compressors according to a sealing method of the compression chambers. In the tip seal type scroll compressor, a tip seal is installed at the wrap end of each scroll, and the tip seal is levitated when the compressor is driven, causing the levitated tip seal to adhere to a plate portion of the opposite scroll. In the back pressure type scroll compressor, a back pressure chamber is formed on a rear surface of a first scroll, and oil or refrigerant having an intermediate pressure is guided into the back pressure chamber. Then, the first scroll is adhered to a second scroll facing the first scroll by pressure in the back pressure chamber. Generally, the tip seal method is applied to a low-pressure scroll compressor, whereas the back pressure method is applied to a high-pressure scroll compressor.

The scroll compressor performs an orbit motion with two side surfaces of an orbiting scroll in an axial direction contacting a fixed scroll and a main frame, respectively. Precise manufacture/processing of the orbiting scroll may minimize/eliminate vibration of the orbiting scroll and frictional loss. To this end, a bearing surface contacting the main frame may be processed first, and then a wrap may be processed. However, this may be relatively time consuming, and the bearing surface may be damaged when the wrap portion is processed. Further, design and fabrication of the orbiting scroll may be relatively complicated due to the shapes of the orbiting scroll and the fixed scroll, and in particular the shape and the size of the wrap portion may be variable according to the capacity of the compressor.

Additionally, a frictional force between the bearing surface of the fixed scroll and the bearing surface of the orbiting scroll may be variable according to a pressure applied to the back pressure chamber. Accordingly, in order to prevent refrigerant leakage and to reduce frictional force, the pressure applied to the back pressure chamber may be properly maintained. A relatively high pressure may be applied to the back pressure chamber, because the orbiting scroll of the scroll compressor is supported by the pressure in the back pressure chamber. Further, when the pressure in the back pressure chamber is varied, sealing performance between the orbiting scroll and the fixed scroll may be inconsistent. Especially, the pressure in the back pressure chamber may be influenced by a discharge pressure, and the discharge pressure may vary according to a load applied to the compressor. Therefore, a sealing function and frictional loss between the orbiting scroll and the fixed scroll may be influenced by the change of a load applied to the compressor.

A scroll compressor may include a separation-type orbiting scroll having an orbiting scroll that is divided into a wrap portion which forms compression chambers while engaged with a fixed scroll, and a base portion for supporting the wrap portion in an axial direction, and for making the wrap portion orbit by receiving a driving force from a crank shaft coupled thereto, with a back pressure chamber provided between the wrap portion and the base portion.

As the separation-type orbiting scroll is divided into the wrap portion and the base portion, it may be easy to fabricate/process such an orbiting scroll. Further, as the back pressure chamber is provided between the wrap portion and the base portion, the wrap portion may be stably supported, even by a relatively small back pressure, and degradation in sealing performance and frictional loss occurring from a change in discharge pressure may be reduced. However, since the wrap portion is closely attached to the fixed scroll, oil may not be smoothly supplied to a thrust bearing surface between the wrap portion and the fixed scroll. This may increase frictional loss. Additionally, in a low-pressure scroll compressor, an upper surface of the fixed scroll and an inner wall surface of the case may form a discharge space in which a predetermined amount of oil remains. This may cause oil deficiency in the compressor, resulting in reduced lubrication. Further, if a suction side is blocked while the compressor is operated, refrigerant and oil may not be smoothly supplied into the compression chambers. This may cause a high vacuum in the compressor. As a result, the temperature of the compressor may increase, and a power connection part may be damaged due to discharge between terminals.

Figure 2:
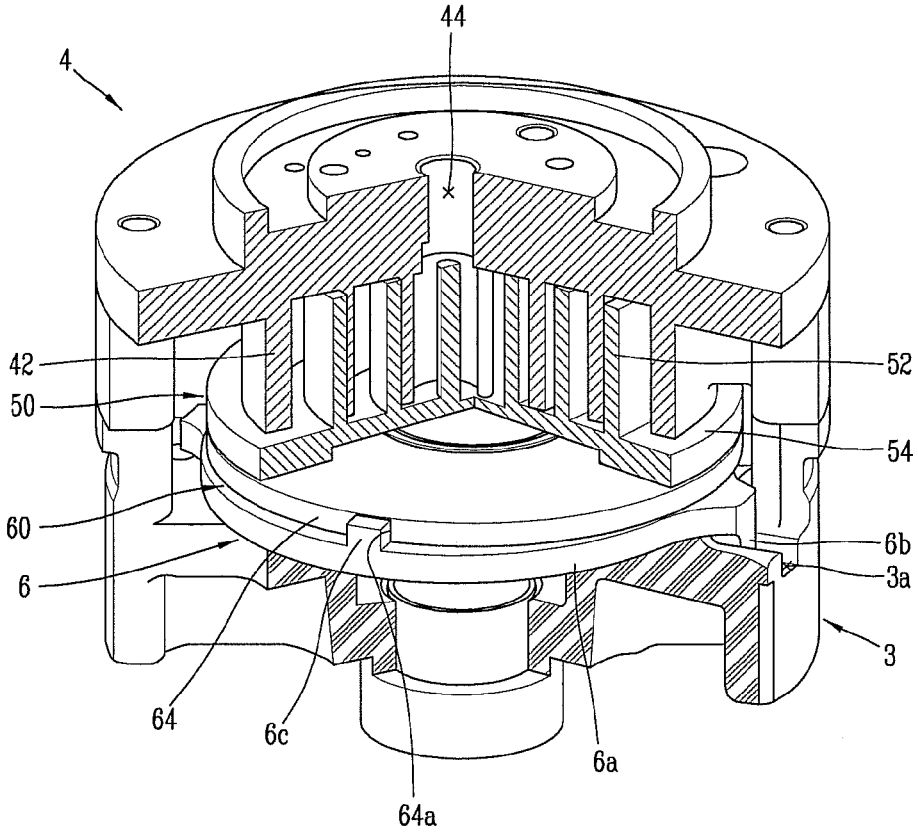
FIG. 2 is a partial cutaway view of a mechanical compression part the compressor shown in of FIG. 1.
Figure 3:
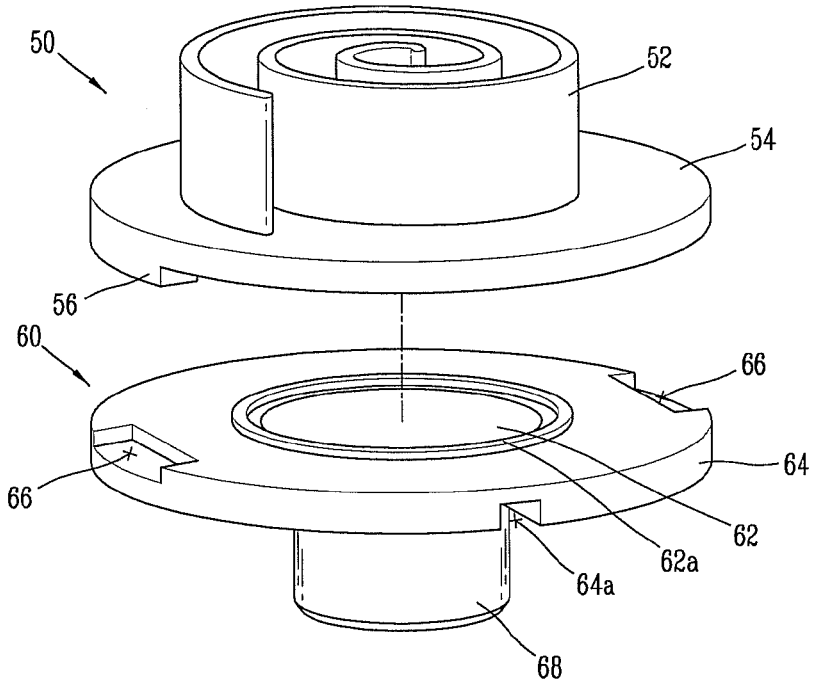
FIG. 3 is a disassembled perspective view of an orbiting scroll of the compressor shown in FIG. 1.

As shown in FIGS. 1 to 3, a scroll compressor as embodied and broadly described herein may include a case 1 having an inner space divided into a suction space 11 (low pressure pare and a discharge space 12 (high pressure part), a driving motor 2 for providing a rotational force installed in the suction space 11 of the case 1, and a main frame 3 fixedly-installed between the suction space 11 and the discharge space 12 of the case 1.

A fixed scroll 4 is fixedly-installed on an upper surface of the main frame 3. An orbiting scroll 5, which forms a pair of compression chambers (P) that consecutively move together with the fixed scroll 4 by being eccentrically-coupled to a crank shaft 23 of the driving motor 2, is installed between the main frame 3 and the fixed scroll 4 so as to perform an orbiting motion. An Oldham's ring 6 for preventing rotation of the orbiting scroll 5 may be installed between the main frame 3 and the orbiting scroll 5.

A suction pipe 13 may be coupled to the suction space 11 of the case 1 so as to be communicated therewith, and a discharge pipe 14 may be coupled to the discharge space 12 so as to be communicated therewith. As described above, the inner space of the case 1 may be divided into a suction space (low pressure part) and a discharge space (high pressure part), in certain embodiments by a discharge plenum forming the sealed discharge space 12 and fixedly-coupled to the fixed scroll 4. Alternatively, the inner space of the case 1 may be divided into a suction space and a discharge space by a high-low pressure separation plate fixed to an upper surface of the fixed scroll 4 and adhered to an inner circumferential surface of the case 1.

The fixed scroll 4 may be provided with a fixed wrap 42 protruding from the bottom surface of a plate portion 41 and formed in an involute shape so as to form the compression chambers (P) together with an orbiting wrap 52 protruding from a wrap portion 50 of the orbiting scroll 5. A suction opening 43 (refer to FIGS. 8 and 9) may be formed on an outer circumferential surface of the plate portion 41 of the fixed scroll 4, so that the suction space 11 of the case 1 may communicate with the compression chambers (P). A discharge opening 44 may be formed at a central part of the plate portion 41 of the fixed scroll 4, so that the discharge space 12 of the case 1 may communicate with the compression chambers (P).

The orbiting scroll 5 may include a wrap portion 50 engaged with the fixed scroll 4, and a base portion 60 coupled to the wrap portion 50.

The wrap portion 50 may include an orbiting wrap 52 which forms compression chambers (P) by engagement with the fixed wrap 42, and a wrap flange 54 integrally formed with the orbiting wrap 52. The wrap flange 54 may have a disc shape, and may be provided with key portions 56. The key portions 56 may be formed at two sides of the bottom surface of the wrap flange 54, and may be coupled to the base portion 60.

The base portion 60 may be coupled to the wrap portion 50 facing the bottom surface of the wrap flange 54. More specifically, the base portion 60 may include a base flange 64 having a disc shape in a similar manner to the wrap flange 54, and a boss portion 68 formed on the bottom surface of the base flange 64 and coupled to the crank shaft 23.

Key grooves 66 for coupling with the key portions 56 may be formed at two edge portions of the upper surface of the base flange 64. As the key portions 56 are inserted into the key grooves 66, the wrap portion 50 may move with respect to the base portion 60 in an axial direction of the crank shaft 23. However, in this case, the wrap portion 50 cannot move in a radial direction or a circumferential direction of the crank shaft 23. Since the movement of the wrap portion 50 in an axial direction is restricted by a gap between the fixed scroll 4 and the main frame 3, the key portions 56 may remain inserted into the key grooves 66. That is, the key portions 56 and the key grooves 66 may be stably coupled to each other with just the key portions 56 inserted into the key grooves 66, without using a bolt-coupling method or a welding method.

The Oldham's ring 6 serving as a rotation preventing device, may be coupled to the bottom surface of the base portion 60. More specifically, the Oldham's ring 6 may include a ring-shaped portion 6*a* contacting the bottom surface of the base flange 64. First protrusions 6*b* having a phase difference of 180° from each other may be formed at two sides of the bottom surface of the ring-shaped portion 6*a*. The first protrusions 6*b* may be inserted into first protrusion recesses 3*a* of the main frame 3. Second protrusions 6*c* having a phase difference of 180° from each other may be formed at two sides of the upper surface of the ring-shaped portion 6*a*. The second protrusions 6*c* may be inserted into second protrusion recesses 64*a* formed on the bottom surface of the base flange 64, respectively.

When so configured, even if a rotational force of the crank shaft 23 is transferred to the base portion 60, the base portion 60 performs an orbit motion without being rotated, and the wrap portion 50 coupled to the base portion 60, which is prevented from moving in a radial direction, also performs an orbit motion together with the base portion 60.

Figure 4:
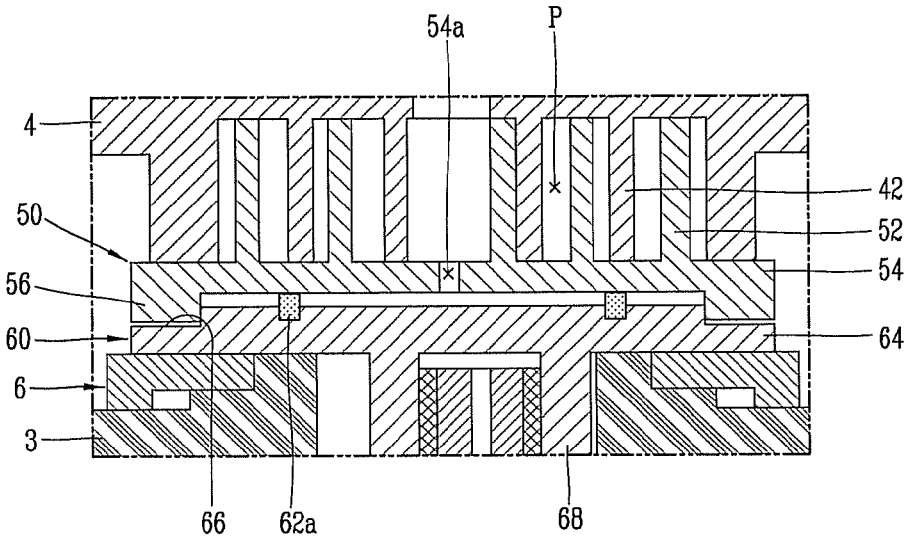
FIG. 4 is a sectional view of an orbiting scroll of the compressor shown in FIG. 1.

A back pressure chamber 62 having a seal 62*a* may be formed on the upper surface of the base flange 64. Referring to FIG. 4, the back pressure chamber 62 may be provided between the bottom surface of the wrap flange 54 and the upper surface of the base flange 64. The inner space of the back pressure chamber 62 may be separated from the suction space 11 (low pressure part) by the seal 62*a* inserted into and fixed to the base flange 64. A back pressure hole 54*a* for communicating the inner space of the back pressure chamber 62 with the compression chambers (P) may penetrate the wrap flange 54.

Accordingly, refrigerant compressed in the compression chambers may be partially introduced into the back pressure chamber 62 through the back pressure hole 54*a*. Since the inner pressure of the back pressure chamber 62 is higher than the peripheral pressure of the base flange 64, the wrap portion 50 is prevented from moving upward from the base portion 60 in an axial direction. Further, this may prevent bending of a central part of the wrap portion 50 towards the base portion 60 due to a pressure of the compression chambers. When so configured, a gap between the bottom surface of the fixed scroll 4 and the orbiting wrap 52 may be sealed.

The inner pressure of the back pressure chamber 62 may be determined according to the position of the back pressure hole 54*a*. That is, as the back pressure hole 54*a* moves close to the center of the orbiting wrap 52 of the orbiting scroll 5, the pressure in the back pressure chamber 62 increases. On the other hand, as the back pressure hole 54*a* moves towards the outside of the orbiting wrap 52 of the orbiting scroll 5, the pressure in the back pressure chamber 62 decreases.

Figure 5:
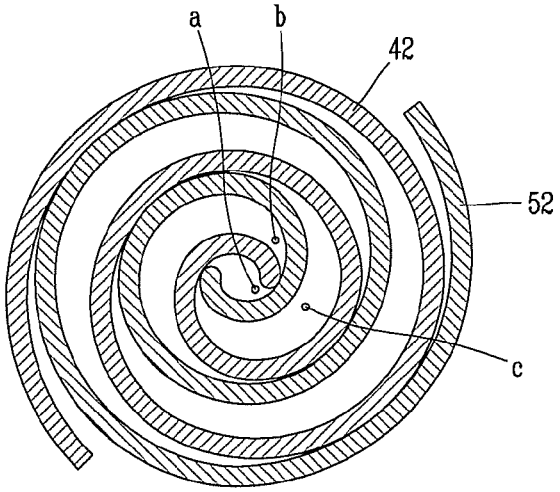
FIGS. 5 to 7 are planar views illustrating operation of the scroll compressor shown in FIG. 1.
Figure 6:
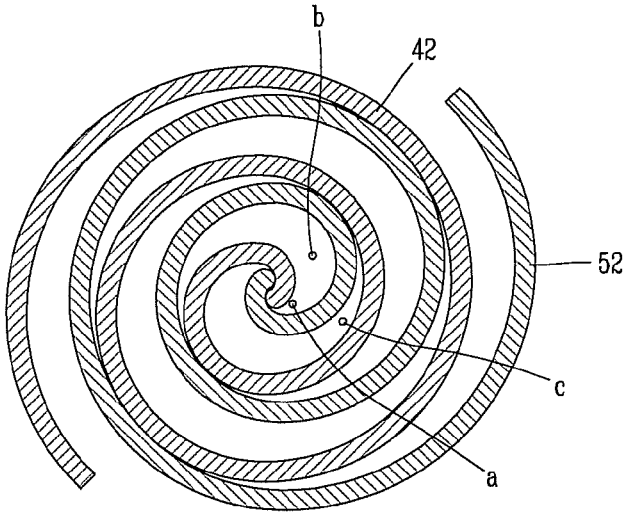
Figure 7:
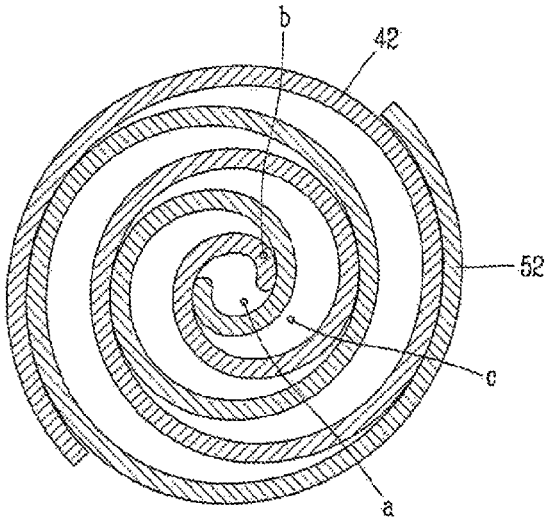

FIGS. 5 to 7 are planar views illustrating a process in which refrigerant is compressed by the orbiting wrap and the fixed wrap. Referring to FIG. 7, as a pressure in a final compression chamber reaches a discharge pressure, a discharge operation is initiated. As aforementioned, the pressure in the compression chambers formed by the orbiting wrap and the fixed wrap continuously changes during a compression operation. Accordingly, a pressure at any point on the orbiting wrap also continuously changes in a single compression cycle.

For instance, if the back pressure hole 54*a* is positioned at 'a', the same pressure as a discharge pressure is applied to the back pressure chamber 62, because the point 'a' is a position where a discharge pressure is maintained during a compression operation. In this case, a strong thrust force (frictional force in an axial direction) is generated between the bottom surface of the fixed scroll 4 and the orbiting wrap 52 due to an excessive back pressure. This may cause frictional loss to be increased. Further, a discharge pressure is variable according to the amount of a compression load applied to the compressor. Accordingly, if the back pressure hole 54*a* is formed at the point 'a' where a discharge pressure is continuously applied, the frictional force in an axial direction (thrust force) is variable according to a load. This may influence the performance of the compressor. More specifically, the point 'a' is within the range of a discharge starting angle (hereinafter, will be referred to as '$\alpha$').

Referring to FIG. 6, the point 'b' is a position where a discharge pressure is applied for a predetermined time duration during a compression operation, and an intermediate pressure between a suction pressure and a discharge pressure is applied for the remaining time duration. Accordingly, if the back pressure hole 54*a* is formed at the point 'b', a proper back pressure may be obtained, and a discharge pressure changed by the change of a load, etc. may be attenuated by the intermediate pressure. The present inventor has certified that the point 'b' is within the range of 180°, from the discharge starting angle of the orbiting wrap, i.e., '$\alpha$+180'.

As shown in FIG. 7, the point 'c' is a point where only an intermediate pressure is continuously applied during a compression operation. Accordingly, if a back pressure hole 54*a* is formed at the point 'c', a back pressure is too low and there may be difficulty in obtaining sufficient sealing. This may cause leakage of refrigerant.

The scroll compressor may also include a sub-frame 7, a discharge valve 8, a stator 21 and a rotor 22.

In a scroll compressor as embodied and broadly described herein, refrigerant is introduced into the suction space 11 (low pressure part) of the case 1 through the suction pipe 13 from a refrigerating cycle. Then, the low-pressure refrigerant in the suction space 11 is introduced into the compression chambers (P) through the suction opening 43 of the fixed scroll 4, and moves to a central part of the orbiting scroll 5 and the fixed scroll 4 by the orbiting scroll 5. Then, the refrigerant is compressed to be discharged to the discharge space 12 of the case 1 through the discharge opening 44 of the fixed scroll 4. Such processes are repeatedly performed.

A refrigerant discharged to the discharge space 12 may contain oil. The refrigerant separated from the oil is discharged to a refrigerating cycle, whereas the oil separated from the refrigerant remains in the discharge space 12. As the amount of oil remaining in the discharge space 12 increases, an oil deficiency may occur in the refrigerating cycle. This may lower a refrigerating capacity, and may greatly lower a lubrication function due to oil deficiency.

Figure 8:
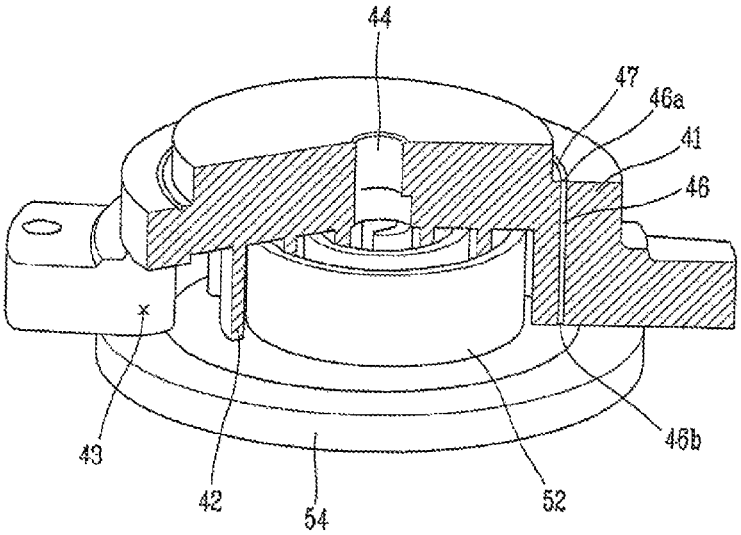
FIG. 8 is a partial cutaway perspective view of a fixed scroll of the scroll compressor shown in FIG. 1.
Figure 9:
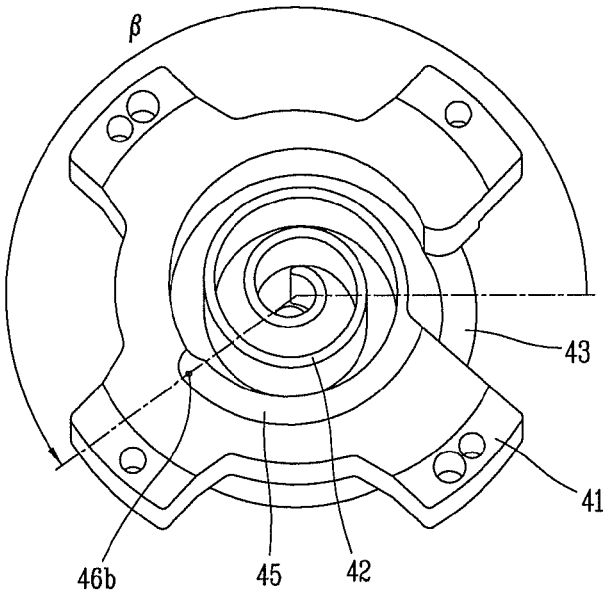
FIG. 9 is a bottom view of the fixed scroll shown in FIG. 8, illustrating an outlet of a communication hole.
Figure 10:
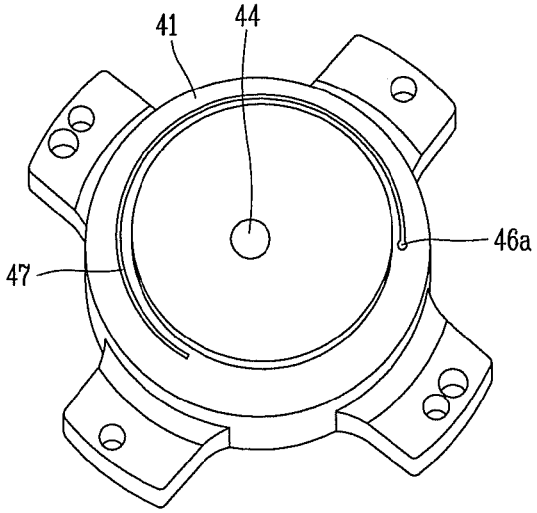
FIG. 10 is a top view of the fixed scroll shown in FIG. 8, illustrating an extension groove extending from an inlet of a communication hole.

As shown in FIGS. 8 to 10, a communication hole 46 for communicating the discharge space 12 with the compression chambers (P) may be formed at the fixed scroll 4. FIG. 8 is a partial cutaway perspective view showing a communication hole of a fixed scroll of the scroll compressor, FIG. 9 is a bottom view of the fixed scroll of FIG. 8 showing an outlet of a communication hole, and FIG. 10 is a top view of the fixed scroll of FIG. 8 showing an extension groove extending from an inlet of a communication hole.

As shown, the communication hole 46 may penetrate from the upper surface to the bottom surface of the fixed scroll 4. An inlet 46*a* of the communication hole 46 may communicate with an upper surface of the fixed scroll 4 which forms the discharge space 12, and an outlet 46*b* of the communication hole 46 may communicate with the bottom surface of the fixed scroll 4 which forms a thrust bearing surface 45.

An extension groove 47 may be formed at the inlet 46*a* of the communication hole 46 for reduction of suction pressure. The extension groove 47 may have a circular shape or an arc shape, such that an oil passage is long enough to lower an oil pressure.

In certain embodiments, the outlet 46*b* of the communication hole 46 may be formed near the suction opening 43, such that refrigerant and oil introduced through the suction opening 43 rapidly move to the compression chambers (P).

The suction opening 43 may penetrate one side surface of the fixed scroll 4, and an outer compression pocket is not necessarily formed within the range of a predetermined crank angle (about 180°), based on the suction opening 43. Accordingly, the bottom surface of the fixed scroll 4 is not necessarily provided with a thrust bearing surface within the range of the predetermined crank angle, and may include stepped portions so as to be spaced apart from the wrap portion 50 of the orbiting scroll 5. Therefore, the crank angle ($\beta$) where the outlet 46*b* of the communication hole 46 is formed, may be within the range of about 270°, based on the center of the suction opening 43, i.e., a part which forms the thrust bearing surface 45.

In a scroll compressor as embodied and broadly described herein, high-pressure gas compressed in the compression chambers (P) may be introduced into the back pressure chamber 62 between the wrap portion 50 and the base portion 60 of the orbiting scroll 5. Then, the wrap portion 50 may be levitated by pressure of the back pressure chamber 62. As a result, the distal end of the orbiting wrap 52 of the wrap portion 50 is closely attached to the corresponding surface of the plate portion of the fixed scroll 5, thereby sealing the compression chambers (P). At the same time, a thrust surface formed on the upper surface of the wrap flange 54 of the wrap portion 50, i.e., the outer side of the orbiting wrap 5, is closely attached to a corresponding thrust surface of the fixed scroll, thereby forming the thrust bearing surface 45.

The refrigerant and oil discharged to the discharge space 12 may be separated from each other. Then, the oil may be introduced to the thrust bearing surface 45 through the communication hole 46, thereby lubricating the thrust bearing surface 45. The oil having lubricated the thrust bearing surface 45 may then be introduced into the compression chambers (P), thereby lubricating a sliding surface between the fixed scroll 4 and the orbiting scroll 5.

If a suction side is blocked while the compressor is operated, a suction pressure of refrigerant sucked through the suction opening 43 may be excessively lowered. This may cause an excessively high vacuum in the compression chambers, resulting in damage to the compressor. If the suction pressure of the refrigerant sucked through the suction opening 43 is lowered, a pressure in the compression chambers (P) is also lowered. This may lower a pressure in the back pressure chamber 62. As a result, the wrap portion 50 may not be sufficiently levitated, and the thrust bearing surface 45 of the fixed scroll 4 corresponding to the thrust surface of the wrap flange 54 is separated from the thrust surface of the wrap flange 54. This opens the outlet 46*b* of the communication hole 46, so that the discharge space 12 and the suction side of the compression chambers (P) communicate with each other. In this arrangement, the refrigerant in the discharge space 12 is introduced into the compression chambers (P) to thereby prevent a high vacuum state in the compression chambers (P).

In a case in which the scroll compressor having a check valve is stopped, the wrap portion 50 is moved downward, and thus the thrust surface of the wrap flange 54 is separated from the thrust bearing surface 45 of the fixed scroll 4. This opens the outlet 46*b* of the communication hole 46, and the discharge space 12 and the compression chambers (P) communicate with each other. Accordingly, the refrigerant in the discharge space 12 (high pressure part) is introduced into the compression chambers (P) (low pressure part), so that the discharge space and the compression chambers are in a pressure equilibrium state. If operation of the scroll compressor is re-initiated, the pressure in the compression chambers increases more rapidly than the pressure in the discharge space, thereby resulting in a normal discharge process.

In a scroll compressor as embodied and broadly described herein, the communication hole for communicating the discharge space and the thrust bearing surface with each other, may be formed at the fixed scroll. Accordingly, oil discharged to the discharge space is introduced to the thrust bearing surface, and lubricates the thrust bearing surface. This may reduce frictional loss occurring between the fixed scroll and the orbiting scroll.

Further, if a high vacuum is about to occur while the compressor is operated, the refrigerant in the discharge space may be introduced into the compression chambers through the communication hole. This may prevent the occurrence of a high vacuum to thereby prevent damage to the compressor. Additionally, when the compressor is stopped, a pressure equilibrium may be performed through the communication hole. This may allow the compressor to rapidly resume normal driving. As a result, performance of the compressor may be enhanced.

When compressing a refrigerant while performing an orbit motion, a non-uniform moment may be applied to the orbiting scroll 5 due to a gas repulsive force. If the non-uniform moment is not effectively reduced, the orbiting scroll 5 may experience unstable behavior. This may increase frictional loss or abrasion between the orbiting scroll 5 and the fixed scroll 4, or between the orbiting scroll 5 and the main frame 3, or between the wrap portion 50 and the base portion 60. This may lower the reliability and/or performance of the compressor.

In embodiments as broadly described herein, the center of the back pressure chamber 62 which supports the orbiting scroll 5 in an axial direction may be eccentrically positioned at a point where a non-uniform moment is the greatest. This may prevent unstable behavior of the orbiting scroll 5. Generally, a non-uniform moment occurring on the orbiting scroll 5 while the crank shaft 23 performs a single rotation may be greatest when refrigerant is discharged. Therefore, in order to effectively reduce the non-uniform moment, the center of the back pressure chamber 62 may be positioned at a point where refrigerant starts to be discharged.

Figure 11:
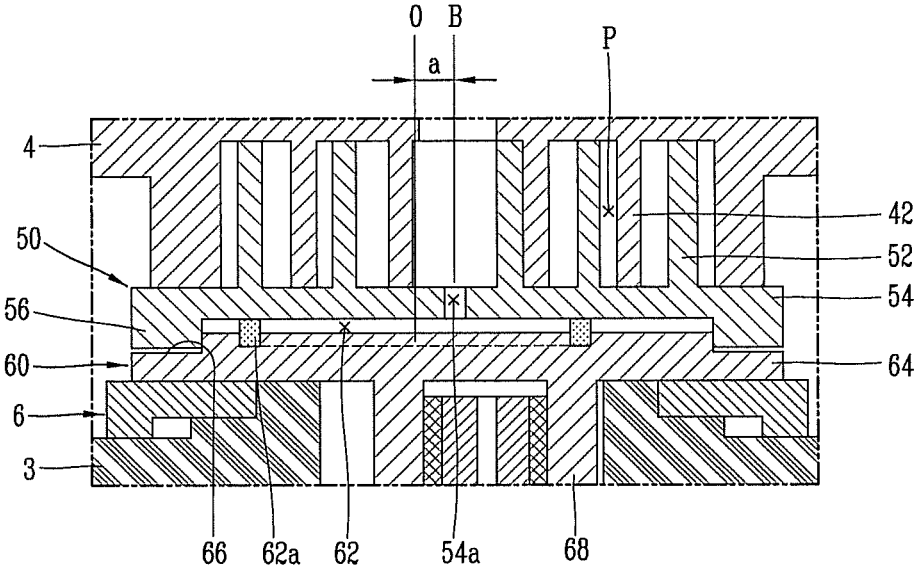
FIG. 11 is a sectional view and FIG. 12 is a planar view of a wrap portion of an orbiting scroll, illustrating the position of a back pressure chamber of the scroll compressor shown in FIG. 1.
Figure 12:
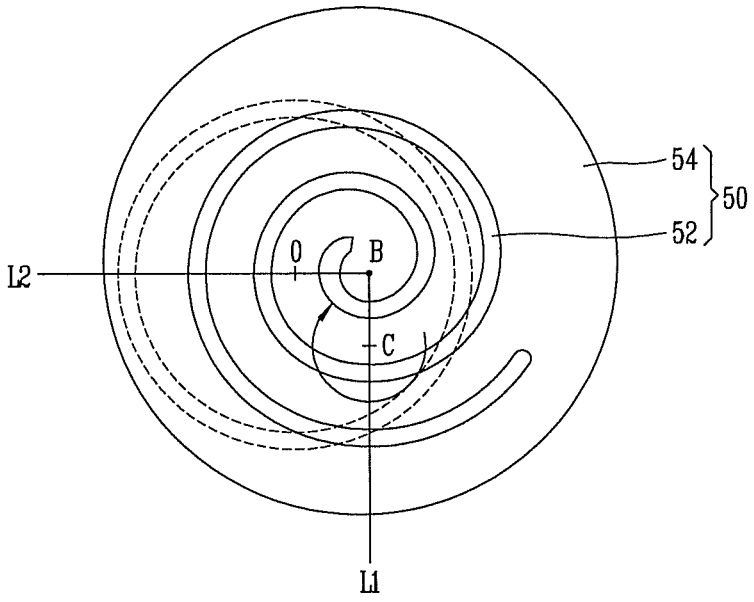

Referring to FIGS. 11 and 12, it is assumed that a line which connects a geometric center (B) of the orbiting scroll 5 with a rotation center (axial center) (C) of the crank shaft 23 is a first virtual line (L1), and a line perpendicular to the first virtual line (L1) is a second virtual line (L2). Under such assumption, a gas repulsive force is applied to the orbiting scroll 5 in a direction of the second virtual line (L2), a direction resistive to rotation.

The center (O) of the back pressure chamber 62 may be eccentric from the geometric center (B) of the orbiting scroll 5 by a predetermined gap, so as to be positioned within the range of ±30° from the second virtual line (L2) positioned on the opposite side to a direction where a gas repulsive force is applied, preferably, so as to be positioned on the second virtual line (L2) where a gas repulsive force is applied.

A scroll compressor is provided that is capable of smoothly supplying oil to a thrust bearing surface between a wrap portion and a fixed scroll.

A scroll compressor is provided that is capable of preventing oil deficiency therein, by collecting oil remaining in a discharge space formed by an upper surface of a fixed scroll and an inner wall surface of a case.

A scroll compressor is provided that is capable of preventing a high vacuum therein even if a suction side is blocked during an operation.

A scroll compressor as embodied and broadly described herein may include a case; a fixed scroll installed in the case; a wrap portion configured to form compression chambers by being engaged with the fixed scroll, and configured to form a thrust bearing surface together with the fixed scroll; a base portion coupled to the wrap portion, and configured to support the wrap portion so as to be movable towards the fixed scroll, in a state where a back pressure chamber is formed between the base portion and the wrap portion; a driving motor coupled to a rear surface of the base portion, and configured to eccentrically rotate the base portion and the wrap portion; and a main frame installed in the case, and configured to support the base portion in an axial direction, wherein an inner wall surface of the case and an upper surface of the fixed scroll form a discharge space where a refrigerant and oil discharged from the compression chambers are filled, and a communication hole for communicating the discharge space with a space between the fixed scroll and the wrap portion is formed at the fixed scroll.

A scroll compressor according to another embodiment as broadly described herein may include a fixed scroll having a fixed wrap; and an orbiting scroll having an orbiting wrap and performing an orbit motion with respect to the fixed scroll, in which a pair of compression chambers that consecutively move are formed between the orbiting scroll and the fixed scroll, wherein the orbiting scroll is divided into a plurality of parts in an axial direction, wherein a back pressure chamber for filling a refrigerant introduced from the compression chambers is formed between the parts, and wherein a communication hole is penetratingly-formed on an upper surface of the fixed scroll towards a bearing surface of the orbiting scroll.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a case;

a fixed scroll and an orbiting scroll installed in the case, the fixed scroll defining a communication hole therethrough and including a bottom surface, the communication hole having an inlet disposed at an upper surface of the fixed scroll adjacent a discharge space that directly opens out to the discharge space and an outlet disposed at the bottom surface, the orbiting scroll including:

a wrap portion including a surface and engaged with the fixed scroll so as to form a plurality of compression chambers therebetween, the surface of the orbiting scroll facing toward the bottom surface of the fixed scroll and the wrap portion being configured to form a thrust bearing surface together with the fixed scroll where the surface of the orbiting scroll engages the bottom surface of the fixed scroll; and a base portion coupled to the wrap portion and configured to be moveable toward the fixed scroll to support the wrap portion, a back pressure chamber is formed between the base portion and the wrap portion, and the scroll compressor further comprising;

a drive motor coupled to the base portion, at a side of the base portion opposite a side thereof at which the wrap portion is coupled, wherein the drive motor is configured to eccentrically rotate the base portion and the wrap portion;

a main frame installed in the case, wherein the main frame supports the base portion in an axial direction;

the discharge space defined by an inner wall surface of the case and the upper surface of the fixed scroll, wherein refrigerant and oil discharged from the plurality of compression chambers are received in the discharge space; and the communication hole provides fluid communication of at least one of the oil or the refrigerant from the discharge space through the inlet to the outlet of the communication hole such that:

(i) the oil in the discharge space flows from the discharge space to the thrust bearing surface through the outlet of the communication hole when the surface of the wrap portion of the orbiting scroll engages the bottom surface of the fixed scroll and a levitation of the wrap portion occurs due to the back pressure applied from the back pressure chamber so that the oil disposed on the thrust bearing surface provides lubrication for the fixed scroll and the orbiting scroll during operation of the fixed scroll, and (ii) if suction side of the scroll compressor is blocked during the operation of the scroll compressor such that the back pressure of the back pressure chamber decreases such that the surface of the orbiting scroll disengages from the bottom surface of the fixed scroll the refrigerant in the discharge space flows through the communication hole and through the outlet and into the plurality of compression chambers to prevent a high vacuum state of the plurality of compression chambers from occurring, wherein the base portion includes:

a boss coupled to a rotational shaft of the drive motor; and a base flange that extends radially outward from the boss and faces the wrap portion, wherein the back pressure chamber is formed on a side surface of the base flange facing the wrap portion.

2. The scroll compressor of claim 1, further including an extension groove that extends from the communication hole along the upper surface of the fixed scroll.

3. The scroll compressor of claim 2, wherein the extension groove is formed in a circular shape or an arch shape.

4. The scroll compressor of claim 1, further including a suction opening formed in the fixed scroll, in communication with the plurality of compression chambers.

5. The scroll compressor of claim 1, further including a ring shaped seal installed between the base portion and the wrap portion, wherein the back pressure chamber is formed within a periphery of the seal.

6. The scroll compressor of claim 5, wherein a geometric center of the ring shaped seal is eccentric from a geometric center of the orbiting scroll.

7. The scroll compressor of claim 1, wherein the wrap portion includes:

a wrap flange that faces the base portion;

an orbiting wrap that extends from the wrap flange and engages with a fixed wrap of the fixed scroll; and a back pressure hole that extends through the wrap flange to provide communication between the back pressure chamber and the plurality of compression chambers.

8. The scroll compressor of claim 7, Wherein the back pressure hole is formed at a position at which a discharge pressure and an intermediate pressure, Which is between the discharge pressure and the suction pressure are applied to the back pressure chamber.

9. The scroll compressor of claim 1, wherein the case is divided into a first space having a first pressure and a second space having a second pressure, the first pressure being different from the second pressure, and wherein the wrap portion and the base portion are installed in the one of the first or second space having a lower pressure.

10. A scroll compressor, comprising:

a case;

a fixed scroll and an orbiting scroll installed in the case, the fixed scroll defining a communication hole therethrough and including a bottom surface, the communication hole having an inlet disposed at an upper surface of the fixed scroll adjacent a discharge space that directly opens out to the discharge space and an outlet disposed at the bottom surface, the orbiting scroll including:

a wrap portion including a surface and engaged with the fixed scroll so as to form a plurality of compression chambers therebetween, the surface of the orbiting scroll facing toward the bottom surface of the fixed scroll and the wrap portion being configured to form a thrust bearing surface together with the fixed scroll where the surface of the orbiting scroll engages the bottom surface of the fixed scroll; and a base portion coupled to the wrap portion and configured to be moveable toward the fixed scroll to support the wrap portion, a back pressure chamber is formed between the base portion and the wrap portion, and the scroll compressor further comprising:

a drive motor including a crank shaft coupled to the base portion, at a side of the base portion opposite a side thereof at which the wrap portion is coupled wherein the drive motor is configured to eccentrically rotate the base portion and the wrap portion;

a main frame installed in the case, wherein the main frame supports the base portion in an axial direction;

the discharge space defined by an inner wall surface of the case and the upper surface of the fixed scroll, wherein refrigerant and oil discharged from the plurality of compression chambers are received in the discharge space; and the communication hole provides fluid communication of at least one of the oil or the refrigerant from the discharge space through the inlet to the outlet of the communication hole such that:

(i) the oil in the discharge space flows from the discharge space to the thrust bearing surface through the outlet of the communication hole when the surface of the wrap portion of the orbiting scroll engages the bottom surface of the fixed scroll and a levitation of the wrap portion occurs due to the back pressure applied from the back pressure chamber so that the oil disposed on the thrust bearing surface provides lubrication for the fixed scroll and the orbiting scroll during operation of the fixed scroll, and (ii) if a suction side of the scroll compressor is blocked during the operation of the scroll compressor such that the back pressure of the back pressure chamber decreases such that the surface of the orbiting scroll disengages from the bottom surface of the fixed scroll the refrigerant in the discharge space flows through the communication hole and through the outlet and into the plurality of compression chambers to prevent a high vacuum state of the plurality of compression chambers from occurring, wherein if a line that connects a geometric center of the orbiting scroll with a rotational center of the crank shaft is defined as a first virtual line and a line perpendicular to the first virtual line and passing through the geometric center of the orbiting scroll is defined as a second virtual line and the first virtual line and the second virtual line are respectively disposed in a plane transverse to a rotational axis of the crank shaft, the geometric center of the back pressure chamber as extended in to the plane is eccentrically located from the geometric center of the orbiting scroll as extended in to the plane within a range of about ±30° from the second virtual line within the plane.

11. The scroll compressor of claim 10, further including a ring shaped seal installed between the base portion and the wrap portion, wherein the back pressure chamber is formed within a periphery of the seal.

12. The scroll compressor of claim 11, further including a back pressure hole formed in the wrap portion to provide communication between the plurality of compression chambers and the back pressure chamber.

13. The scroll compressor of claim 12, wherein the back pressure hole is formed at a position at which a discharge pressure and an intermediate pressure, which is between the discharge pressure and a suction pressure, are applied to the back pressure chamber.

14. The scroll compressor of claim 10, further including an extension groove that extends from the communication hole along the upper surface of the fixed scroll.

15. The scroll compressor of claim 14, wherein the extension groove is formed in a circular shape or an arch shape.

* * * * *